US006402628B1

(12) United States Patent
Neil

(10) Patent No.: US 6,402,628 B1
(45) Date of Patent: Jun. 11, 2002

(54) BILLIARDS CUE

(76) Inventor: Robert W. Neil, 2124 Schenectady Ave., Brooklyn, NY (US) 11234

( * ) Notice: Subject to any disclaimer, the term of this patent is extended or adjusted under 35 U.S.C. 154(b) by 0 days.

(21) Appl. No.: 08/425,735

(22) Filed: Apr. 20, 1995

(51) Int. Cl.[7] ..... A63D 15/08
(52) U.S. Cl. ..... 473/44; D21/232
(58) Field of Search ..... 473/44, 46, 47, 473/48; 273/81.4, 81.6; D21/210, 222, 232

(56) References Cited

U.S. PATENT DOCUMENTS

| | | | | |
|---|---|---|---|---|
| D22,972 S | * | 12/1893 | Rieper | 473/44 |
| 692,970 A | | 2/1902 | Zaehringer | |
| 1,212,038 A | | 1/1917 | Flaxman | |
| 1,262,262 A | | 4/1918 | Ruiz | |
| 1,296,285 A | | 3/1919 | Greenfield | |
| 1,436,579 A | * | 11/1922 | Dayton | 273/81.4 |
| 1,638,454 A | * | 8/1927 | Papin | 273/81.4 |
| 3,381,959 A | | 5/1968 | Le Fiell | |
| 3,534,959 A | | 10/1970 | Elswick | 273/68 |
| 4,314,575 A | * | 2/1982 | Kuo | 273/46 |
| 4,511,147 A | | 4/1985 | Olsen | 273/68 |
| 4,688,796 A | | 8/1987 | Wright | 273/68 |
| D320,058 S | * | 9/1991 | Reyes | D21/232 |
| D323,013 S | * | 1/1992 | Golden | |
| D360,007 S | * | 7/1995 | Farr | D21/210 |

FOREIGN PATENT DOCUMENTS

| | | | |
|---|---|---|---|
| GB | 20623 | * of 1905 | 273/81.6 |

* cited by examiner

*Primary Examiner*—Paul T. Sewell
(74) *Attorney, Agent, or Firm*—Mary A. Whiting, Esq.

(57) ABSTRACT

A cue for the four basic shots of billiards: soft, medium, hard, and break shot. In use, the present invention allows the player to shoot the cue on a straight line four to six inches through the cue ball by enhancing the player's physical feel and mental visualization of said straight line by aligning the player's index and thumb fingers of the stroking hand, into the groove corresponding to the desired basic soot of pool, the next two fingers are aligned on the flat surface between the above mentioned groove and the adjacent groove nearer the free end of the butt end portion of the cue, which aligns the pinky finger, to give the sensation of a straight line. The groove furthest from the free end of the butt end portion, corresponds to a soft shot, the adjacent groove, corresponds to a medium shot, the next adjacent groove, corresponds to a hard shot, and the next adjacent groove, corresponds to a break shot. An optional groove, nearest to the free end of the rear butt portion, can be added if the player desires to execute a power break/straight shot. The invention can be fitted to the player's hand size by varying the spacing between the grooves.

4 Claims, 1 Drawing Sheet

BILLIARDS CUE

BACKGROUND

1. Field of the Invention

The present invention relates to a method and/or novel and improved cue, and more particularly, to a novel handle portion, for use in the game of pocket billiards, pool, or similar stick games, wherein the player's stroking hand on the cue is placed in proper position for best alignment of the cue on a straight line four to six inches through the cue ball, in order to stroke the object ball into the pocket of the player's choice. In situations where the four basic shots of billiards (or optional fifth shot) are implemented: soft, medium, hard, break shot (or power/straight shot), the instant invention is particularly useful.

The desired device, suitable for players of average ability, consists of four grooves carved concentric to the device's diameter, located on the handle of the rear butt portion of the cue. The method of the device is utilized by placing the player's index and thumb fingers of the stroking hand into the groove corresponding to the desired basic shot of billiards. The next two fingers are aligned on the surface portion between the above-mentioned groove and the adjacent groove, when present, located nearer to the free end of the rear butt portion of the cue. This adjacent groove, when present, aligns the pinky finger. Once all the fingers of the stroking hand are so aligned, the player can shoot the cue on a straight line four to six inches through the cue ball. The placement of the fingers can be changed by the player so as to best align the player's stroking grip with the desired basic shot of billiards. The groove furthest from the free end of the rear butt portion of the cue corresponds to a soft shot, the adjacent groove nearer to the free end of the rear butt portion corresponds,to a medium shot, the next adjacent groove nearer to the free end of the rear butt portion corresponds to a hard shot, and the next adjacent groove nearer to free end of the rear butt portion, corresponds to a break shot. An optional groove, also suitable for the average player, nearest to the free end of the rear butt portion, can be added if the player desires to execute a power/straight shot. Thus, when the player's fingers of the stroking and are aligned with the device, the index and thumb fingers will be in one groove, the pinky finger will be in the adjacent groove, when present, nearer to the free end of the rear butt portion of the cue, and the middle and ring fingers will be on the surface portion between grooves.

The above mentioned placement of the fingers to the corresponding grooves is utilized to shoot the cue on the straight line four to six inches through the cue ball, toward the object ball, depending on which of the four basic shots of billiards (or the power/straight shot), the player wishes to execute.

Although the fingers will be placed in different grooves, corresponding to the desired shot, the individual steps, method and spacial relationship of the fingers to the grooves remains the same.

The surface between the grooves can be covered with a conventional wrap of a material such as leather, cork, linen, or thread, to aid the player's grip, and should be sufficiently thin so as to maintain the cue's circumference, in order not to interfere with the placement and portability of the cue into standard cases. The grooves can be fitted to the player's hand size by varying the spacing between them.

2. Description of the Prior Art

Prior art devices which are concerned with an improved handle and/or aiming system of pocket billiards cues or similar stick game devices are exemplified by the following U.S. Pat. Nos.:

| | | |
|---|---|---|
| W. Zaehringer | 692,970 | Feb. 11, 1902 |
| A. E. Flaxman | 1,212,038 | Jan. 9, 1917 |
| V. Ruiz | 1,262,262 | Apr. 9, 1918 |
| A. Greenfield | 1,296,285 | Mar. 4, 1919 |
| J. C. Elswick | 3,534,959 | Oct. 20, 1970 |
| C. K. Le Fiell | 3,381,959 | May 7, 1968 |
| W. A. Olsen | 4,511,147 | Apr. 16, 1985 |
| Wright | 4,688,796 | Aug. 25, 1987 |

U.S. Pat. No. 692,970 issued to W. Zaehringer on Feb. 11, 1902, discloses a device with an adjustable, flexible, corrugated covering on the shank or handle of the cue.

U.S. Pat. No. 1,212,038 issued to A. E. Flaxman on Jan. 9, 1917, discloses a sleeve which is secured to the shaft of the device whereby an improved grip, lessened shock to the hands and arms of the player (billiards, golf, mallet, and any other game/procedure deploying a shaft), and smoother drive, is produced.

U.S. Pat. No. 1,262,262 issued to V. Ruiz on Apr. 9, 1918, discloses a protector, with a corrugated surface, which prevents the hand from slipping, and provides a convenient grip.

U.S. Pat. No. 1,296,285 issued to A. Greenfield on Mar. 9, 1919, discloses a device with an improved billiards cue handle grip or sleeve provided with a knurled surface to afford a good grip, and ornamental surface appearance, which slides over the tapered tip end.

U.S. Pat. No. 3,534,959 issued to J. C. Elswick on Oct. 20, 1970, discloses a device with a combination self-contained guide member which allowed for more accurate aiming with a more uniform thrust of the stick against the ball.

U.S. Pat. No. 3,381,959 issued to C. K. Le Fiell on May 7, 1968, discloses a device with a guiding section with a surface substantially covered with transverse ridges and valleys of a certain degree of coarseness for enhancing a frictional relationship for handgripping, said enhancement surface formed by transversely grinding or abrasive polishing.

U.S. Pat. No. 4,511,147 issued to W. A. Olsen on Apr. 16, 1985, discloses a device with a grooved handle, a weighted head, and acurved shaft to deploy a golf swing trainer.

U.S. Pat. No. 4,688,796 issued to Wright on Aug. 25, 1987, discloses a device of an aiming system for billiards which utilizes a light beam which emerges from the longitudinal end of the cue.

None of the above mentioned references show use of a method and/or device as disclosed in the present invention whereby the player, by placing his fingers in the grooves of the invention corresponding to the desired shot of billiards, can align the fingers of his stroking hand on the cue in the proper position for best alignment of the cue on a straight line four to six inches through the cue ball in order to stroke the object ball into the pocket of the player's choice.

OBJECTS OF THE INVENTION

Accordingly, it is the principal object of the present invention to provide a billiards cue construction enabling the placement of the fingers of the player's stroking hand, in one of the four grooves corresponding to the four desired basic shots of billiards, in proper position for best alignment of the cue corresponding to the shot of the player's desire, on a straight line four to six inches through the cue ball, in order to stroke the object ball into the pocket of the player's choice.

Another object of the present invention is to allow for an additional groove nearest to the free end of the rear butt portion of the cue, if the player desires to execute the power break/straight shot.

Another object of the present invention is to provide for a device and/or method which employs means which are simple in construction and which are relatively inexpensive to produce.

A further object of the present invention is to provide for a portable device which can be stored easily in a standard case, and further, be constructed sturdily enough so that the device will not easily bend, fold or be misshapen during transport, and use.

Still a further object of the present invention is to provide for a device whereby the surface between the grooves can be covered with conventional wrap, to aid the player's grip, while maintaining the cue's circumference, so as not to interfere with the placement and portability of the cue into standard cases.

DRAWING FIGURES

REFERENCE NUMBERS IN DRAWINGS

Figures 1, 2, 3:
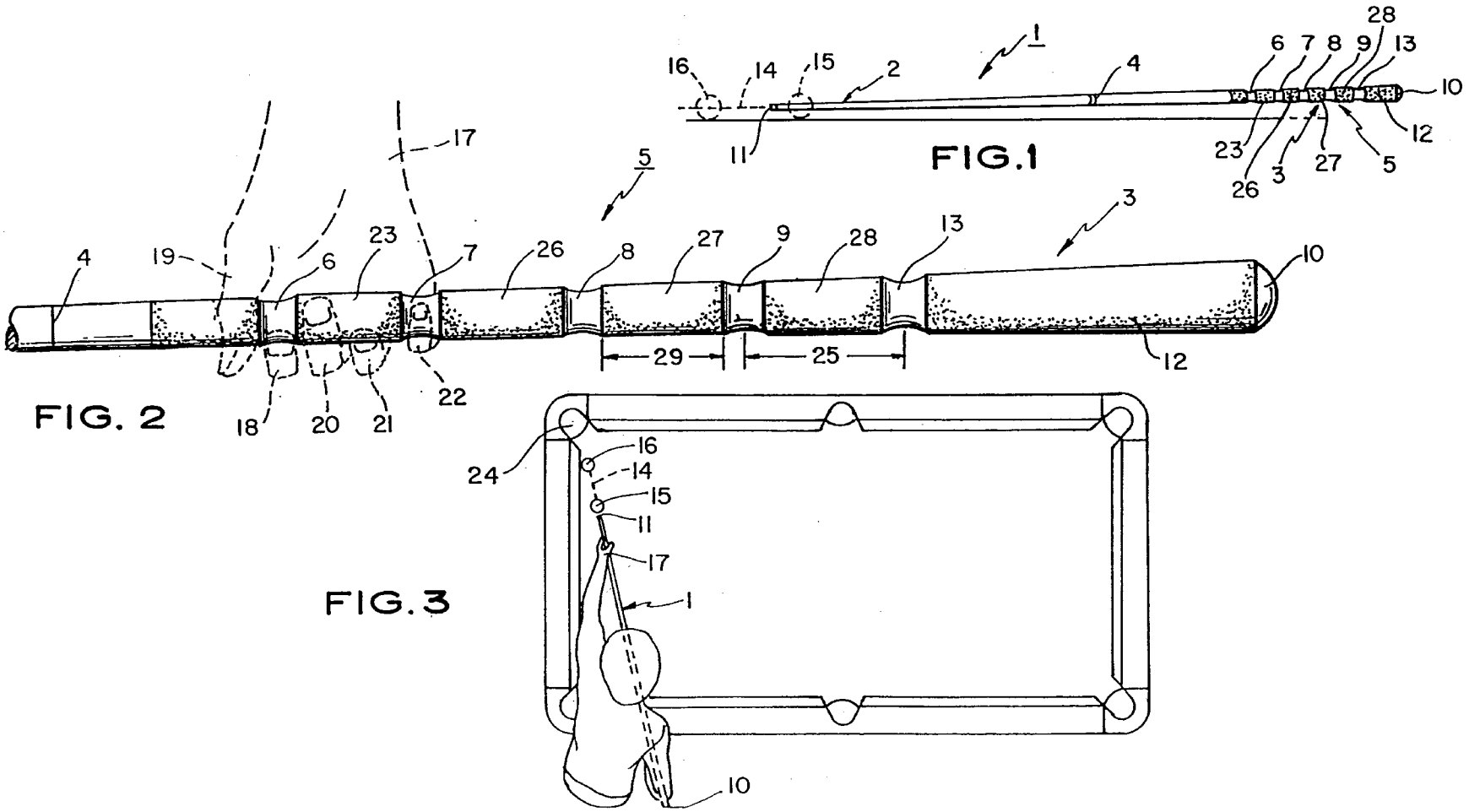
FIG. 1 illustrates a side elevational view of the preferred embodiment of the invention, showing alignment of the cue means on a straight line four to six inches through the cue ball, and with that of the object ball.
FIG. 2 illustrates an enlarged side view of the handle portion of the device in detail, showing the spacing between the groove means and the alignment of the groove means on the rear butt portion of the cue means. Alignment of all of the fingers of the stroking hand, when executing the soft shot, is illustrated.
FIG. 3 illustrates an aerial view of the alignment of the player's body position utilizing the present invention to shoot the cue means on the straight line four to six inches through the cue ball.

1 Cue Means
2 Frontal Shaft Portion
3 Rear Butt Portion
4 Thread Means
5 Grooved Handle Portion
6 Groove Means
7 Groove Means
8 Groove Means
9 Groove Means
10 Free End Portion of Rear Butt Portion
11 Cue Tip Means
12 Conventional Wrap Means
13 Optional Groove Means
14 Straight Line
15 Cue Ball
16 Object Ball
17 Player's Stroking Hand
18 Player's Index Finger of the Stroking Hand
19 Player's Thumb Finger of the Stroking Hand
20 Player's Middle Finger of the Stroking Hand
21 Player's Ring Finger of the Stroking Hand
22 Player's Pinky Finger of the Stroking Hand
23 Surface Portion Between Groove Means 6 & 7
24 Pocket of Billiards Table
25 Distance Mid-Point Between Grooves Means
26 Surface Portion Between Groove Means 7 & 8
27 Surface Portion Between Groove Means 8 & 9
28 Surface Portion Between Groove Means 9 & 13
29 Length of Surface Portion Between Groove Means

DESCRIPTION OF THE PREFERRED EMBODIMENT OF THE INVENTION

FIG. 1 illustrates a side elevational view of the preferred embodiment of the device constructed in accordance with the principles of the present invention which embodies a cue means 1, comprised of a frontal shaft portion 2, and a rear butt portion 3, which are secured together by an interiorly threaded common sleeve or collar, which provides for a thread means 4.

As shown in FIG. 1, and further shown in FIG. 2, the rear butt portion 3, has a grooved handle portion 5, comprised of a plurality of groove means 6, 7, 8, and 9 respectively, concentric to the diameter of the cue means 1. Groove means 6 being farthest from the free end portion 10 of the rear butt portion 3, and closest to the cue tip means 11. Groove means 9 being closest to the free end 10 of the rear butt portion 3, and farthest from the cue tip means 11 Groove means 13, closest to the free end 10 of the rear butt portion 3, can be added if the player desires.

The surface portion 23, 26, 27 and 28, between grooves 6, 7, 8, 9 and 13, respectively, can be covered with conventional wrap means 12, concentric to the diameter of the cue means 1, of a material such as leather, cork, linen or thread, to aid the player's grip, and should be sufficiently thin so as to maintain the cue means 1 circumference, in order not to interfere with the player's placement and portability of the cue means 1 into standard cases.

Groove means 6, 7, 8, 9 and 13, provide for optimum alignment of the cue means 1 on a straight line 14, four to six inches through the cue ball 15, in order to stroke the object ball 16, into the desired pocket of the player's choice.

This straight line 14, is shown in detail in FIG. 3, whereby the alignment of the player's stroking hand 17, in proper position on cue means 1, during execution of the soft shot, allows for best alignment of cue means 1, on said straight line 14, in order to stroke the object ball 16, into the desired pocket 24 of the player's choice.

In situations where the basic shots of billiards are implemented: soft, medium, hard and or break shot, the present invention allows the player to shoot the cue means 1, on straight line 14, four to six inches through the cue ball 15, by enhancing the player's. mental visualization of the straight line 14.

As shown in detail in FIG. 2, the player's index finger 18 and thumb finger 19 of the stroking hand 17, are aligned into the grooves 6, 7, 8, 9 or 13, depending on the desired shot of the player: soft, medium, hard, break or power/straight, respectively. FIG. 2 illustrates the execution of the soft shot. The next two fingers, the middle 20, and ring 21, are aligned on the surface portion 23, between the groove grasped by the thumb 19 and the index finger 18, and the adjacent groove nearest to the free end 10 of the rear butt portion 3 of cue means 1. The pinky finger 22, is aligned in the above mentioned adjacent groove nearest the free end 10 of the rear butt portion 3. Alignment of the fingers of the stroking hand 17, in the above-described position, allows for the player to shoot the cue means 1 on a straight line 14, a range of four to six inches through cue ball 15.

Once the device is so aligned, the position of the fingers can be changed to grasp the groove means corresponding with the desired basic shot of billiards, to best align the player to the desired shot. Groove means 6 corresponds to the soft shot, groove means 7 corresponds to the medium shot, groove means 8 corresponds to the hard shot, groove means 9 corresponds to the break shot and groove means 13 corresponds to the power/straight shot, which can be added if the player desires to hold the rear butt portion 3 of the cue means 1.

As shown in FIG. 1, the mid-point of groove means 6 is located twenty-five percent (25%) from the length of the cue, measured from the free end 10 of the rear butt portion 3. As shown in detail in FIG. 2, the distance 25 between the mid-point of the groove gripped by the thumb 19 and index finger 18, to the mid-point of the adjacent groove gripped by the pinky finger 22 25, between grooved means 6, 7, 8, 9, and 13, is of a range from two and one-half to three and one-quarter (2.5–3.25) inches, in order to correspond to the hand size of the player. The length 29, of surface portion 23, 26, 27, and 28, between groove means, where the middle finger 20, and ring finger 21 are placed, is of a range of one and one-half inches to two and ninety-five hundredths inches (1.5–1.95), in order to. correspond to the hand size of the player. Distance 25 and length 29 are of a constant measurement for each hand size, thereby,symmetrically aligning the grooves and corresponding surface portions therebetween, along the cue means 1. The length 29 of the surface portions 23, 26, 27, and 28, and distance 25 between the mid-points of the groove means 6, 7, 8, 9 and 13, are greater than the length of each of the groove means 6, 7, 8, 9, and 13 measured along the longitudinal axis of the cylindrical rear butt portion 3. Distance 25 between the mid-points of the groove means 6, 7, 8, 9, and 13 has a length greater the length of each of the surface portions 29 measured along the longitudinal axis of the cylindrical rear butt portion 3. The difference between the distance 25 between the mid-points of the grooves 6, 7, ,8 , 9 and 13, and length 29 of the surface portions 23, 26, 27, and 28, comprises the length of each of the groove means measured along the longitudinal axis of the cylindrical rear butt portion 3. The depth of all groove means is two-tenths (0.20) of an inch. Conventional wrap means 12, of leather, cord, linen, or thread materials, can be wrapped around the surface portion 23, 26, 27, of the grooved handle portion 5, between groove means 6, 7, 8 and 9. It can also be wrapped behind groove 9, or 13, depending on the player's preference.

While the specific method of use of the invention has been shown and described in detail, as illustrated in further detail in FIG. 3, it is appreciated that once the user utilizes the method of the invention to shoot the cue means 1 on the straight line 14, and the object ball 16, wherever the object ball 16 is located on the billiards table, to place the object ball 16 into the desired pocket 24.

The above description of the invention is merely exemplary, and the scope of the invention is to be measured by the terms of the following claims and reasonable equivalent thereof.

I claim:

1. A billiards cue adapted for teaching a player proper finger placement in playing a combination of desired shots, including a soft, medium, hard, and break shot, comprising: a tapered frontal shaft portion, a cue tip means for striking a cue ball on said tapered frontal shaft portion, a cylindrical rear butt portion having a free end, thread means for attaching said frontal shaft portion to said rear butt portion, and said rear butt portion further comprising a handle portion having a plurality of groove means and flat surface portions therebetween, adapted to be gripped by fingers of a stroking hand, including, thumb, index, middle, ring finger, and pinky fingers, said plurality of groove means numbering four, including a first groove means furthest from said free end of said rear butt portion corresponding to said soft shot, a second groove means adjacent to said first groove means and nearer to said free end of said rear butt portion corresponding to said medium shot, a third groove means adjacent to said second groove means and nearer to said free end of said rear butt portion corresponding to said hard shot, and a fourth groove means adjacent to said third groove means and nearest to said free end of said rear butt portion corresponding to said break shot; whereby gripping said thumb and index fingers of said stroking hand around said groove means corresponding to said desired shot of billiards, gripping said pinky finger around said adjacent groove means nearer to said free end of said rear butt portion, and gripping said middle and ring finger around said surface portions therebetween, enables said player to stroke said cue on a straight line through said cue ball, in order to stroke a playing ball into a desired pocket.

2. A billiard cue as recited in claim 1, wherein said plurality of groove means further comprises a fifth groove means adjacent to said fourth groove means and nearest to said free end of said cylindrical rear butt portion, corresponding to a power/straight shot of billiards.

3. A billiards cue as recited in claim 1, wherein a distance between mid-points of said adjacent groove means, is of a range from 2.50 to 3.25 inches, whereby said mid-points are substantially of equal length of distance to accommodate gripping said player's thumb and index finger in said groove means corresponding to said desired shot of billiards, said pinky finger on said adjacent groove means nearer to said free end of said rear butt portion, and said middle and ring finger on said flat surface portion therebetween.

4. A billiards cue as recited in claim 1, wherein a length of said flat surface portions therebetween said adjacent groove means is of a range of 1.50 to 1.95 inches, whereby said length of flat surface portions are substantially of equal length of distance to accommodate gripping said middle and ring finger on said flat surface portions.

* * * * *